US009663997B2

(12) United States Patent
Kang et al.

(10) Patent No.: US 9,663,997 B2
(45) Date of Patent: May 30, 2017

(54) INJECTABLE INFLOW CONTROL ASSEMBLIES

(71) Applicant: HALLIBURTON ENERGY SERVICES, INC., Houston, TX (US)

(72) Inventors: James Jun Kang, Dallas, TX (US); Aaron Bonner, Flower Mound, TX (US); Jean-Marc Lopez, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 241 days.

(21) Appl. No.: 14/398,066

(22) PCT Filed: Jun. 14, 2013

(86) PCT No.: PCT/US2013/045818

§ 371 (c)(1),
(2) Date: Oct. 30, 2014

(87) PCT Pub. No.: WO2014/200505

PCT Pub. Date: Dec. 18, 2014

(65) Prior Publication Data

US 2016/0186500 A1 Jun. 30, 2016

(51) Int. Cl.

| | |
|---|---|
| ***E21B 43/12*** | (2006.01) |
| ***E21B 17/00*** | (2006.01) |
| ***E21B 34/08*** | (2006.01) |
| ***E21B 34/06*** | (2006.01) |

(52) U.S. Cl.
CPC ..... *E21B 17/00* (2013.01); *E21B 34/06* (2013.01); *E21B 34/08* (2013.01); *E21B 43/12* (2013.01)

(58) Field of Classification Search
CPC ..... E21B 43/12; E21B 43/082
See application file for complete search history.

(56) References Cited

U.S. PATENT DOCUMENTS

| | | | | |
|---|---|---|---|---|
| 5,803,179 | A | 9/1998 | Echols et al. | |
| 2002/0174981 | A1 | 11/2002 | Den Boer et al. | |
| 2007/0277878 | A1* | 12/2007 | Strattan | E21B 34/105 137/70 |
| 2008/0236843 | A1 | 10/2008 | Scott et al. | |
| 2009/0000786 | A1 | 1/2009 | Daniels et al. | |
| 2009/0101342 | A1* | 4/2009 | Gaudette | E21B 34/08 166/276 |

(Continued)

OTHER PUBLICATIONS

International Patent Application No. PCT/US2013/045818, International Search Report and Written Opinion mailed Mar. 13, 2014, 15 pages.

*Primary Examiner* — George Gray
(74) *Attorney, Agent, or Firm* — Kilpatrick Townsend & Stockton LLP

(57) ABSTRACT

An inflow control assembly can be adjusted subsequent to manufacture and prior to being run downhole in a wellbore. The inflow control assembly can include an outer body and a chamber internal to the outer body. The chamber can define a flow path for fluid flow through the inflow control assembly when the inflow control assembly is in a wellbore traversing a subterranean formation. The flow path is injectable with a pre-determined volume of material from a source external to the outer body for reducing fluid flow through the flow path.

20 Claims, 7 Drawing Sheets

(56) References Cited

U.S. PATENT DOCUMENTS

| | | | | |
|---|---|---|---|---|
| 2009/0218101 | A1* | 9/2009 | Langlais | E21B 33/122 166/313 |
| 2011/0011586 | A1* | 1/2011 | Dusterhoft | E21B 47/01 166/278 |
| 2013/0062061 | A1* | 3/2013 | Taylor | E03B 3/18 166/288 |

* cited by examiner

INJECTABLE INFLOW CONTROL ASSEMBLIES

CROSS-REFERENCE TO RELATED APPLICATIONS

This is a U.S. national phase under 35 U.S.C. 371 of International Patent Application No. PCT/US2013/045818, titled "Injectable Inflow Control Assemblies" and filed Jun. 14, 2013, the entirety of which is incorporated herein by reference.

TECHNICAL FIELD OF THE INVENTION

The present invention relates generally to assemblies for controlling fluid flow in a bore in a subterranean formation and, more particularly (although not necessarily exclusively), to assemblies that are injectable with material for reducing fluid flow through the assemblies.

BACKGROUND

Various assemblies can be installed in a well traversing a hydrocarbon-bearing subterranean formation. Some assemblies include devices that can control the flow rate of fluid between the formation and tubing, such as production or injection tubing. An example of these devices is an inflow control device, such as an autonomous inflow control device that can select fluid, or otherwise control the flow rate of various fluids into the tubing.

Inflow control assemblies with devices that can be adjusted subsequent to being manufactured and prior to being located in a wellbore are desirable.

SUMMARY

Certain aspects of the present invention are directed to an adjustable inflow control assembly, such as an autonomous inflow control assembly. The inflow control assembly can be adjusted subsequent to manufacture and prior to being run downhole into a wellbore.

One aspect relates to an inflow control assembly that includes an outer body and a chamber internal to the outer body. The chamber can define a flow path for fluid flow through the inflow control assembly when the inflow control assembly is in a wellbore traversing a subterranean formation. The flow path is injectable with a pre-determined volume of material from a source external to the outer body for reducing fluid flow through the flow path.

Another aspect relates to a method by which an inflow control assembly can be adjusted. A manufactured inflow control assembly is prepared for adjustment. A material is injected into a flow path in a chamber internal to the manufactured inflow control assembly. The manufactured inflow control assembly with injected material is run into a wellbore. The injected material at least partially blocks fluid flow through the flow path.

Another aspect relates to an inflow control device that includes a chamber defining a flow path that is injectable prior to being run into a wellbore with a pre-determined volume of material from an external source for reducing an amount of fluid flow through the inflow control device when the inflow control device is in the wellbore.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and features relate to an inflow control device, such as an autonomous inflow control device, in which the pressure drop or flow volume of fluids passing through the device is adjustable prior to the inflow control device being installed into a well. A material can be injected into the inflow control device, or into an assembly that includes the inflow control device, to at least partially block fluid flow through the device after the device is installed in a wellbore.

For example, the material can be injected on the rig floor as joints including inflow control devices are being lowered into a well, enabling the adjustability of the inflow control device "on the fly." The material used for injection may be a sealant, or otherwise a material that can block or reduce fluid flow. Examples of the material include cements, polymers, glues, and gels.

In one aspect, an inflow control assembly is provided that includes an outer body and a chamber that is internal to the outer body. The chamber can define a flow path for fluid flow through the inflow control assembly when the inflow control assembly is in a wellbore. The flow path is injectable with a pre-determined volume of material from a source external to the outer body for reducing fluid flow through the flow path. The volume of material can be determined on the rig, for example, to provide the desired fluid flow blocking performance.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

Figure 1:
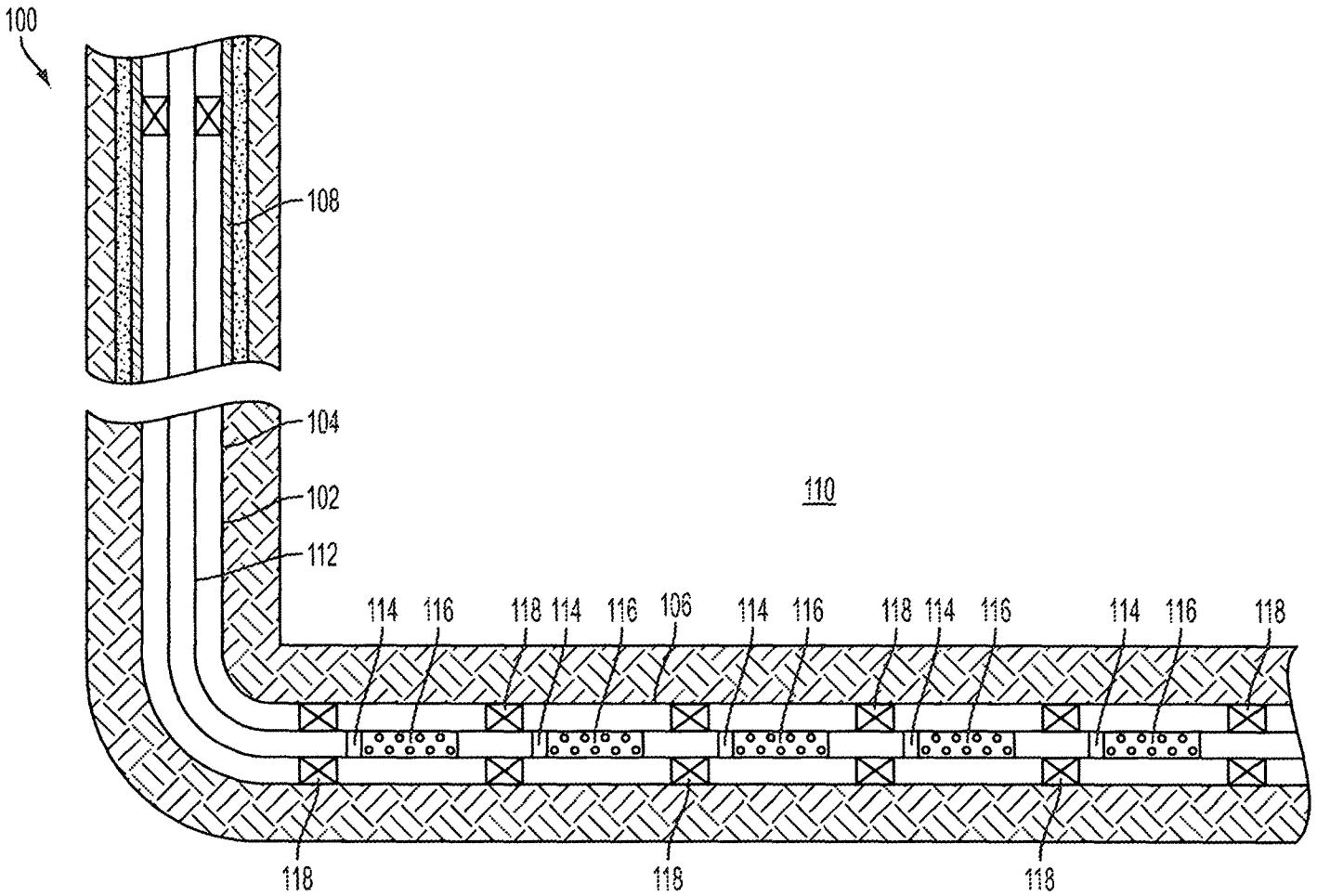
FIG. 1 is a schematic illustration of a well system having inflow control assemblies that are adjustable according to one aspect of the present invention.

FIG. 1 depicts a well system 100 with inflow control devices that are adjustable according to certain aspects of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Inflow control devices 114 and production tubular sections 116 in various production intervals adjacent to the formation 110 are positioned in the tubing string 112. On each side of each production tubular section 116 is a packer 118 that can provide a fluid seal between the tubing string 112 and the wall of the wellbore 102. Each pair of adjacent packers 118 can define a production interval.

Each of the production tubular sections 116 can provide sand control capability. Sand control screen elements or filter media associated with production tubular sections 116 can allow fluids to flow through the elements or filter media, but prevent particulate matter of sufficient size from flowing through the elements or filter media. In some aspects, a sand control screen may be provided that includes a non-perforated base pipe having a wire wrapped around ribs positioned circumferentially around the base pipe. A protective outer shroud that includes perforations can be positioned around an exterior of a filter medium.

Inflow control devices 114 can include chambers through which fluid can flow. Inflow control devices 114 may be autonomous inflow control devices that autonomously restrict or resist production of formation fluid from a production interval in which unwanted fluid, such as water or natural gas for an oil production operation, is entering. Formation fluid flowing into a production tubular section 116 may include more than one type of fluid, such as natural gas, oil, water, steam and carbon dioxide. Steam and carbon dioxide may be used as injection fluids to cause hydrocarbon fluid to flow toward a production tubular section 116. Natural gas, oil and water may be found in the formation 110. The proportion of these types of fluids flowing into a production tubular section 116 can vary over time and be based at least in part on conditions within the formation and the wellbore 102.

An inflow control device 114 that is an autonomous inflow control device can reduce or restrict production from an interval in which fluid having a higher proportion of unwanted fluids is flowing through the inflow control device 114. When a production interval produces a greater proportion of unwanted fluids, an inflow control device 114 in that interval can restrict or resist production from that interval. Other production intervals producing a greater proportion of wanted fluid, can contribute more to the production stream entering tubing string 112. For example, the inflow control device 114 can include channels that can control fluid flow rate based on one or more properties of fluid, where such properties depend on the type of fluid—wanted or unwanted fluid.

Although FIG. 1 depicts inflow control devices 114 positioned in the substantially horizontal section 106, inflow control devices 114 (and production tubular sections 116) according to various aspects of the present invention can be located, additionally or alternatively, in the substantially vertical section 104. Furthermore, any number of inflow control devices 114, including one, can be used in the well system 100 generally or in each production interval. In some aspects, inflow control devices 114 can be disposed in simpler wellbores, such as wellbores having only a substantially vertical section. Inflow control devices 114 can be disposed in open hole environments, such as is depicted in FIG. 1, or in cased wells.

Figure 2:
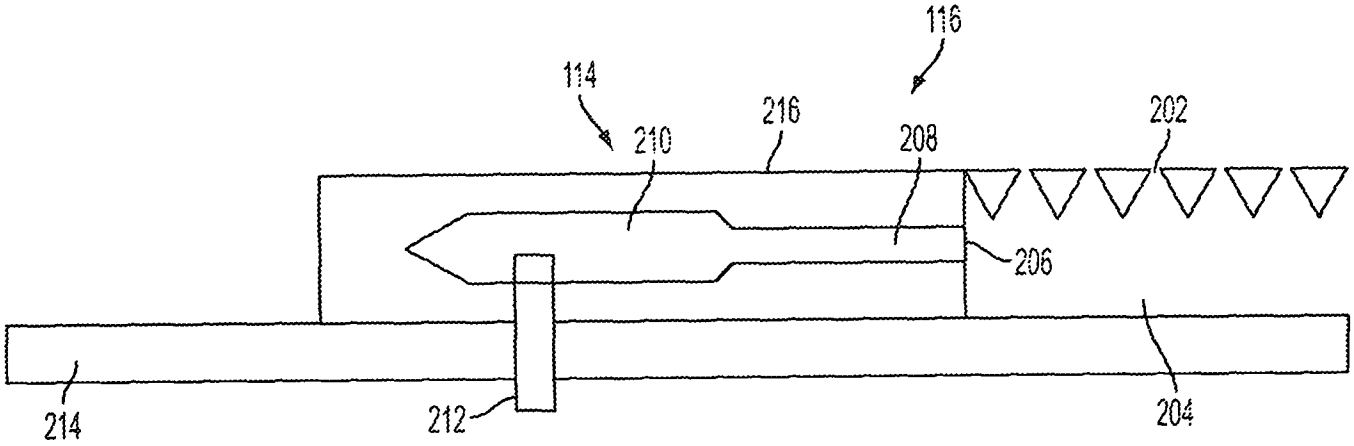
FIG. 2 is a cross-sectional side view of an adjustable inflow control assembly according to one aspect of the present invention.

FIG. 2 depicts a cross-sectional side view of a production tubular section 116 that includes an inflow control device 114 and a screen assembly 202. The inflow control device 114 in FIG. 2 is an autonomous inflow control device, but other types of inflow control devices can be used. The production tubular defines an interior passageway 204, which may be an annular space. Formation fluid can enter the interior passageway 204 from the formation through screen assembly 202, which can filter the fluid. Formation fluid can enter the inflow control device 114 from the interior passageway through an inlet 206 to a chamber 208 that defines a flow path leading to a vortex chamber 210. The vortex chamber 210 can restrict or allow fluid to flow though the outlet 212 via an exit opening in the vortex chamber 210 by different amounts to an internal area of tubing 214.

The inflow control assembly of FIG. 2 includes an outer body 216. Internal to the outer body 216 is the chamber 208 defining the flow path. The flow path can be injected with a pre-determined volume of material from a source that is external to the outer body 216 for reducing fluid flow through the flow path.

Figure 3:
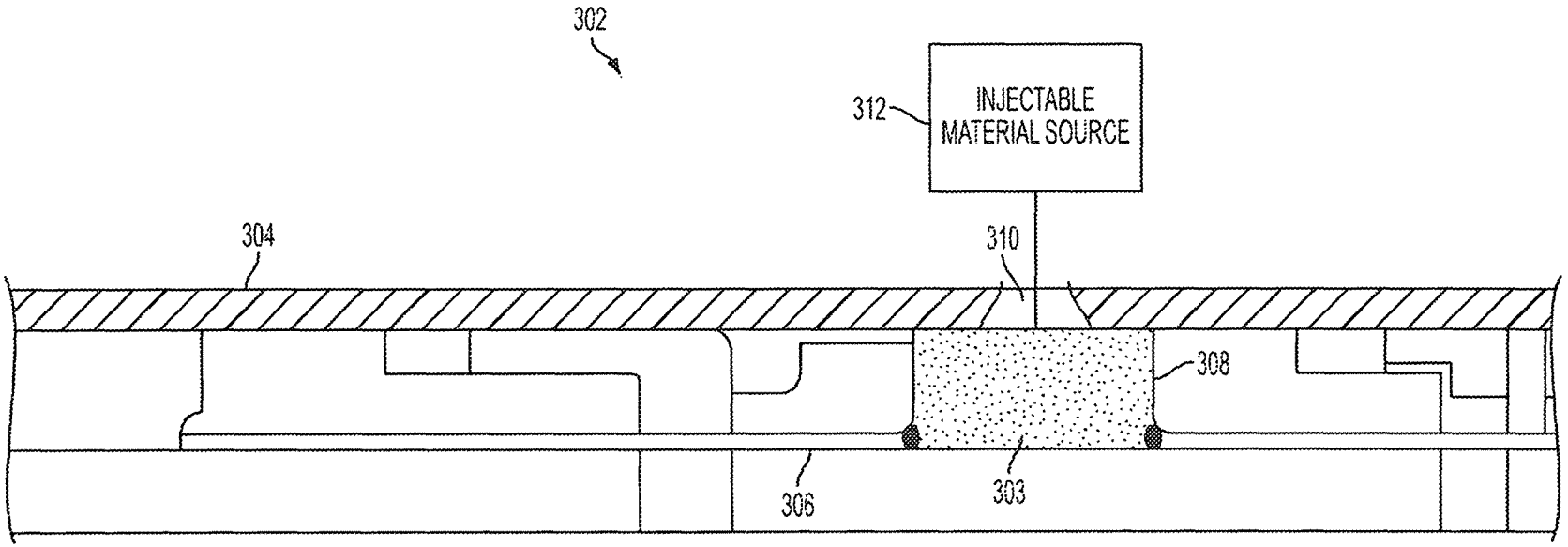
FIG. 3 is a cross-sectional side view of an adjustable inflow control assembly injected with material according to one aspect of the present invention.

FIG. 3 depicts a cross-sectional side view of an example of an inflow control assembly 302 injected with material 303. The inflow control assembly 302 includes an outer body 304. Internal to the outer body 304 is an inflow control device 306 that includes a chamber 308. The outer body 304 includes an opening 310 through which material 303 can pass from an injectable material source 312 external to the outer body 304 to a flow path defined by the chamber 308, as represented by the arrow in FIG. 3. The material 303 can be collected in the chamber 308. The material 303 can at least partially block fluid flow through the flow path defined by the chamber 308.

For example, the inflow control assembly 302 may include one or more inflow control devices and chambers, each associated with a separate opening in the outer body 304. On the rig floor, or otherwise before the inflow control assembly 302 is located in the wellbore and after the inflow control assembly 302 is manufactured, the material 303 can be injected into the flow path to vary the amount of flow, or pressure drop, provided by one or more of the inflow control devices. In some aspects, the openings in the outer body 304 can be sealed by an outer covering or other component after the material is injected and/or if no material is injected into an opening. For example, the openings may be threaded ports that can receive plugs.

Figure 4:
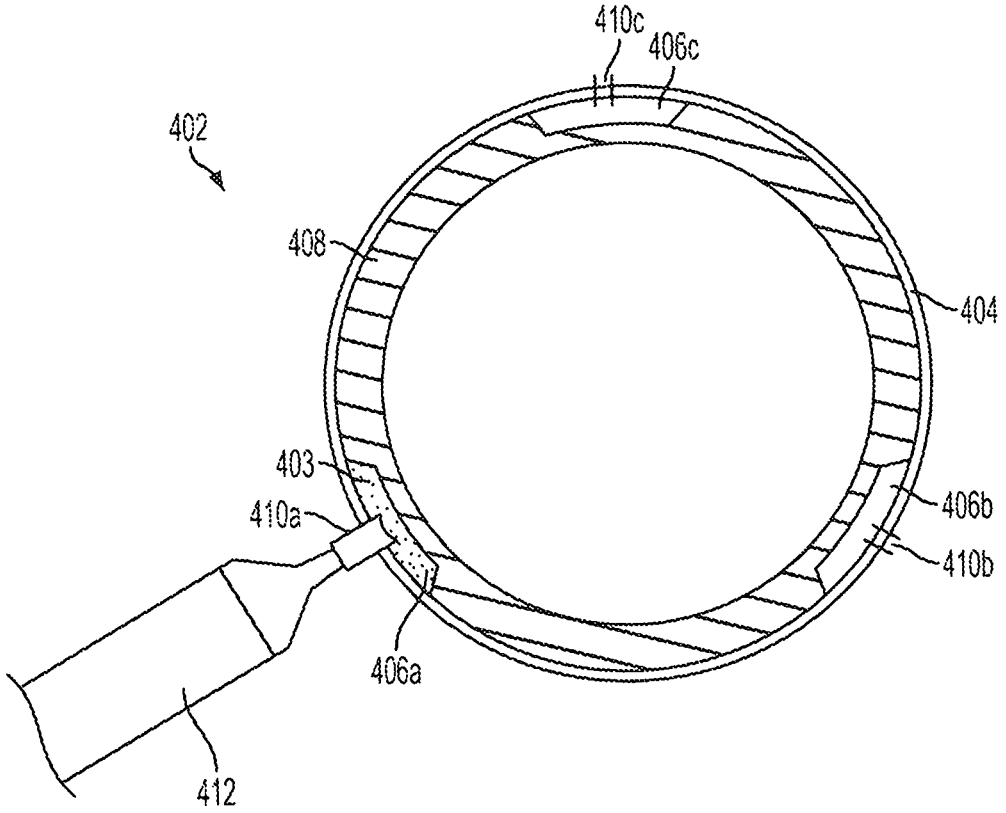
FIG. 4 is a cross-sectional view of another example of an adjustable inflow control assembly according to one aspect of the present invention.

FIG. 4 depicts a cross-sectional view of another example of an inflow control assembly 402 injected with material 403. The inflow control assembly 402 includes an outer body 404 that may be a sealing sleeve. Internal to the outer body 404 are chambers 406*a-c* that define flow paths and that are separated by an inflow control device housing 408. Each of the chambers 406*a-c* may be a channel that leads to an autonomous inflow control device carbide, for example. The chambers 406*a-c* include ports in which are one-way valves 410*a-c* that allow the material 403 to pass from a source 412 external to the outer body 404 to the respective chambers 406*a-c*. For example, one-way valve 410*a* allows material 403 from the source 412 that is an injection gun to pass to the flow path defined by chamber 406*a*. The flow paths of the chambers 406*a-c* can be separately injectable with material 403. The one-way valve 410*a* can receive the injection gun and allow the material 403 from the injection gun to flow to the flow path defined by the chamber 406*a*. The material 403 can be collected in the chamber 406*a* and at least partially block fluid flow through the flow path defined by the chamber 406*a*. The one-way valves 410*a-c* can be configured to prevent well fluid, sand, and other contents of a wellbore from entering the chambers 406*a-c* when the inflow control assembly 402 is in the wellbore.

Figure 5:
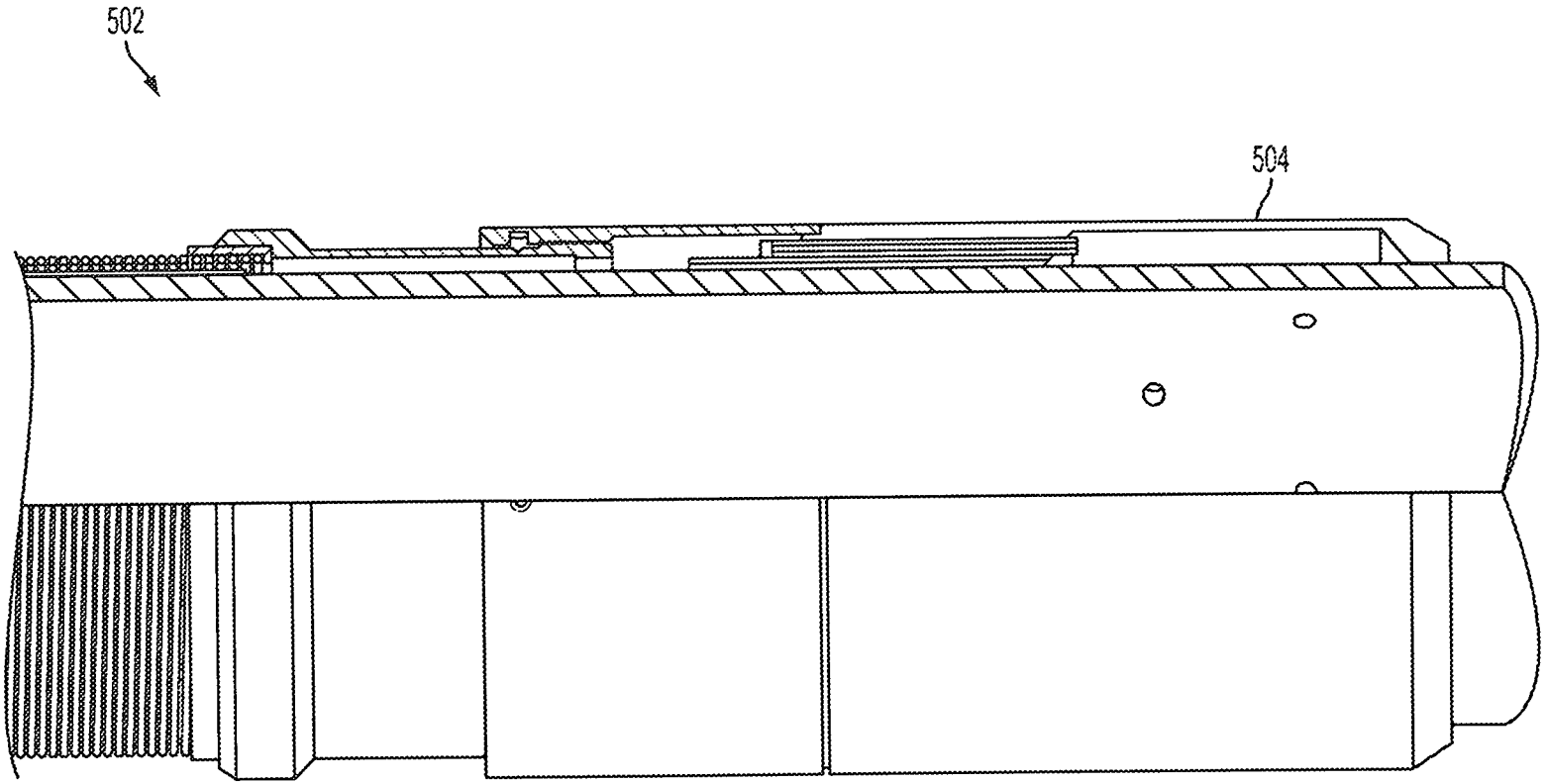
FIG. 5 is a partial cross-sectional side view of another example of an inflow control assembly according to one aspect of the present invention.

In some aspects, an outer body of an inflow control assembly can be removed to allow material to be injected. FIG. 5 depicts a partial cross-sectional side view of an example of an inflow control assembly 502. The inflow control assembly 502 includes an outer body that is an outer housing 504 covering components, which can include inflow control devices, internal to the outer housing 504. The outer housing 504 can be removed. For example, the outer housing 504 can be removed on the rig floor, or otherwise before the inflow control assembly 502 is located in the wellbore. In some aspects, the outer housing 504 can be unthreaded from other portions of the inflow control assembly 502 and slid to allow access to the components internal to the outer housing 504. After the outer housing 504 is removed, material can be injected into the components internal to the outer housing.

Figure 6:
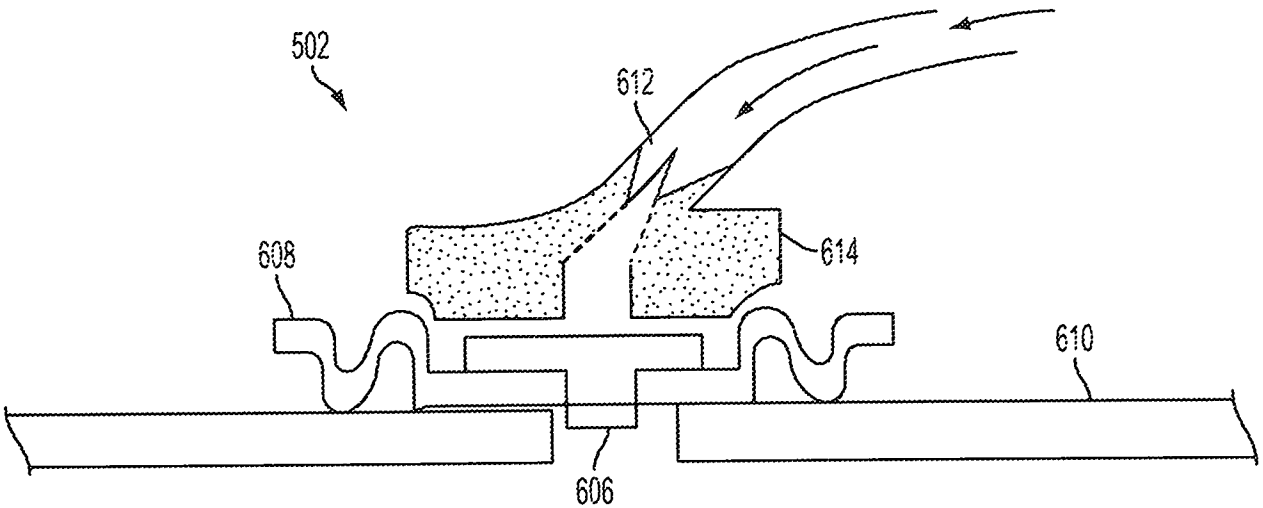
FIG. 6 is a cross-sectional side view of part of the inflow control assembly of FIG. 5 after an outer housing is removed according to one aspect of the present invention.

FIG. 6 depicts a cross-sectional side view of an example of part of the inflow control assembly 502 of FIG. 5 after the outer housing 504 is removed. Removing the outer housing 504 can reveal a carbide 606 that includes a flow path for an inflow control device, such as an autonomous inflow control device. The carbide 606 can be connected to a cradle 608 that is connected, such as by weld, to a base pipe 610. The carbide 606 and cradle 608 together can form an internal component that is constructed for adapting to an injection mandrel 612. As shown by arrows in FIG. 6, the injection mandrel 612 can allow material 614 to pass from an external source (not shown) to the internal component and plug off one or more flow paths in the carbide 606. The injection mandrel 612 can guide the material 614 to fill void space and force the material 614 into one or more flow paths of the carbide 606. The injection mandrel 612 can also be used to control a volume of the material 614 that is injected into the inflow control assembly 502.

Figure 7:
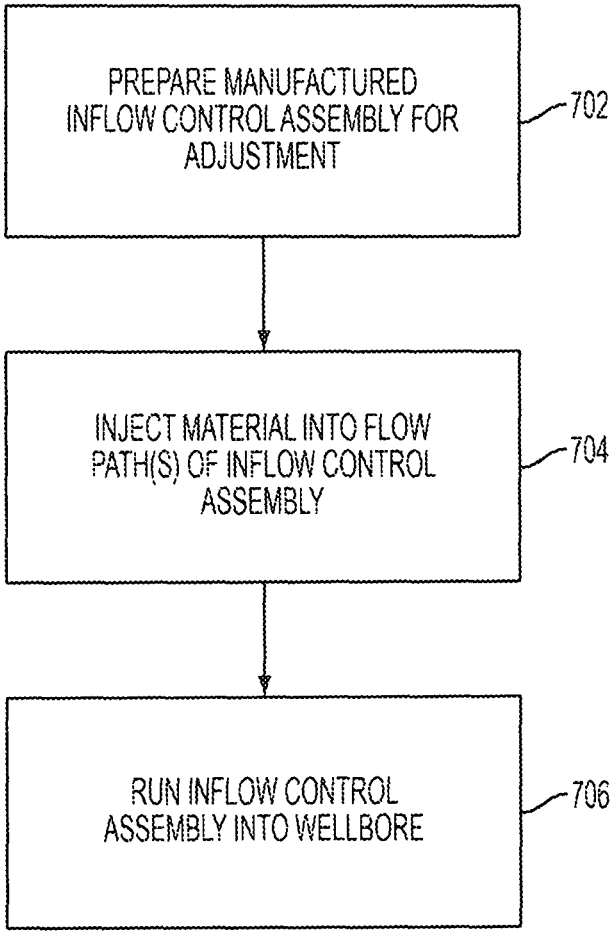
FIG. 7 is a flow chart of a method of adjusting an inflow control assembly according to one aspect of the present invention.

FIG. 7 is a flow chart of an example process for adjusting an inflow control device. In block 702, a manufactured inflow control assembly is prepared for adjustment. Preparing an inflow control assembly can include identifying the flow paths to be adjusted and/or removing an outer housing as described in connection with FIGS. 5 and 6. In block 704, material is injected into flow path(s) of the inflow control assembly. The material can be injected through an opening in an outer housing of the inflow control assembly, through a one-way valve in a port, or an injection mandrel adapted to be received by internal components of the inflow control assembly. The material may be a sealant. In block 706, the inflow control assembly is run into the wellbore after the material is injected into flow path(s) of the inflow control assembly. The material can at least partially block flow paths in which the material is injected when the inflow control assembly is in the wellbore.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An inflow control assembly positioned on a base pipe, comprising:

an outer body; and a carbide coupled to the inflow control assembly by a cradle and defining a flow path for fluid flow through the inflow control assembly when the inflow control assembly is in a wellbore traversing a subterranean formation, wherein the carbide and the cradle form an internal component that is configured to adapt to an injection mandrel for enabling the injection mandrel to inject a material from a source external to the outer body into the flow path to reduce fluid flow through the flow path, wherein the carbide projects radially inward from the cradle and partially into an opening in the base pipe, the carbide having a surface and the cradle being at least partially disposed between the carbide surface and the base pipe.

2. The inflow control assembly of claim 1, wherein the opening in the base pipe is for allowing the material to pass from the injection mandrel to the flow path.

3. The inflow control assembly of claim 1, wherein the outer body includes a port having a one-way valve for allowing the material to pass from the injection mandrel to the flow path.

4. The inflow control assembly of claim 3, wherein the one-way valve is configured for preventing fluid and sand from entering the flow path from an area external to the outer body when the inflow control assembly is in the wellbore.

5. The inflow control assembly of claim 1, wherein the outer body is removable and the internal component is constructed for adapting to the injection mandrel when the outer body is removed from the inflow control assembly.

6. The inflow control assembly of claim 1, wherein the material is a sealant.

7. The inflow control assembly of claim 6, wherein the sealant includes:

cement;

a polymer;

a glue; or a gel.

8. The inflow control assembly of claim 1, wherein the inflow control assembly is an autonomous inflow control assembly.

9. The inflow control assembly of claim 1, wherein the outer body includes:

a first chamber defining a first flow path; and a second chamber independent of the first chamber and defining a second flow path, wherein each of the first flow path and the second flow path is separately injectable with material via the injection mandrel.

10. The inflow control assembly of claim 1, wherein the flow path is injectable with material via the injection mandrel prior to the inflow control assembly being positioned in the wellbore.

11. A method, comprising:

preparing a manufactured inflow control assembly for injection of a material into a flow path defined by a carbide, the carbide being coupled to the manufactured inflow control assembly by a cradle, wherein the carbide projects radially inward from the cradle and partially into an opening in a base pipe, and wherein the carbide has a surface and the cradle is at least partially disposed between the carbide surface and the base pipe;

injecting the material into the flow path using an injection mandrel; and running the manufactured inflow control assembly with injected material into a wellbore, wherein the injected material at least partially blocks fluid flow through the flow path.

12. The method of claim 11, wherein preparing the manufactured inflow control assembly for injection includes removing an outer covering sealing at least one opening corresponding to the flow path.

13. The method of claim 11, wherein preparing the manufactured inflow control assembly for injection includes removing an outer housing of the manufactured inflow control assembly to expose an internal component formed from the carbide and the cradle and configured to adapt to the injection mandrel.

14. The method of claim 13, wherein injecting the material into the flow path includes coupling the injection mandrel to the internal component of the manufactured inflow control assembly and delivering the material through the injection mandrel from a source external to the manufactured inflow control assembly.

15. The method of claim 11, wherein injecting the material into the flow path includes injecting the material through an opening in an outer housing housing using the injection mandrel.

16. The method of claim 11, wherein injecting the material into the flow path includes using the injection mandrel to inject the material from a source external to the outer housing to the flow path internal to the outer housing and through a one-way valve in a port of an outer housing.

17. An inflow control device, comprising:

a carbide defining a flow path and forming at least a portion of an internal component that is configured to adapt to an injection mandrel for enabling the injection mandrel to inject a predetermined volume of material into the flow path, prior to the inflow control device being run into a wellbore, for reducing an amount of fluid flow through the inflow control device when the inflow control device is in the wellbore, wherein the carbide projects radially inward from a cradle and partially into an opening in a base pipe, the carbide having a surface and the cradle being at least partially disposed between the carbide surface and the base pipe.

18. The inflow control device of claim 17, wherein the flow path is injectable with the material through an opening in an outer body of the inflow control device.

19. The inflow control device of claim 17, wherein the flow path is injectable with the material through a one-way valve.

20. The inflow control device of claim 17, wherein the carbide and the cradle collectively form the internal component and the internal component is positioned to be internal to an outer body of the inflow control device when the outer body is connected to the inflow control device.

* * * * *